US005669367A

United States Patent [19]

Sawazaki et al.

[11] Patent Number: 5,669,367

[45] Date of Patent: Sep. 23, 1997

[54] IGNITION APPARATUS FOR INTERNAL COMBUSTION ENGINE

[75] Inventors: Nobuyuki Sawazaki; Shigemi Murata; Mitsuru Koiwa, all of Tokyo, Japan

[73] Assignee: Mitsubishi Denki Kabushiki Kaisha, Tokyo, Japan

[21] Appl. No.: 629,146

[22] Filed: Apr. 8, 1996

[30] Foreign Application Priority Data

May 25, 1995 [JP] Japan ..... 7-126774

[51] Int. Cl.[6] ..... F02P 3/02

[52] U.S. Cl. ..... 123/635; 123/143 C

[58] Field of Search ..... 123/143 C, 195 C, 123/198 E, 635, 647, 634

[56] References Cited

U.S. PATENT DOCUMENTS

| | | | |
|---|---|---|---|
| 4,986,249 | 1/1991 | Nakamura | 123/635 |
| 5,125,386 | 6/1992 | De Filippis et al. | 123/635 |
| 5,152,274 | 10/1992 | Maekawa | 123/635 |
| 5,218,936 | 6/1993 | Pritz et al. | 123/635 |
| 5,261,381 | 11/1993 | Sugiura et al. | 123/635 |
| 5,501,205 | 3/1996 | Betz et al. | 123/635 |

FOREIGN PATENT DOCUMENTS 64-8580 1/1989 Japan .

*Primary Examiner*—Willis R. Wolfe

*Attorney, Agent, or Firm*—Sughrue, Mion, Zinn, Macpeak & Seas

[57] ABSTRACT

In an ignition apparatus for an internal combustion engine including a first cover 1A composed of an insulating material, fixed to a cylinder head and having plug holes 6, ignition coils 20A inserted into the plug holes 6 and igniting a mixed gas in cylinders and a second cover composed of an insulating material and covering the ignition coils 20A, the ignition coils 20A are fixed by means of being held between the first cover 1A and a second cover 11A. With this arrangement, the total height of the ignition apparatus can be lowered as well as the center of gravity of the apparatus is located at a low position to improve a vibration resistant property.

9 Claims, 6 Drawing Sheets

IGNITION APPARATUS FOR INTERNAL COMBUSTION ENGINE

BACKGROUND OF THE INVENTION

1. Field of the Invention

The present invention relates to an ignition apparatus for an internal combustion engine including a first cover fixed to a cylinder head and having plug holes, ignition coils inserted into the plug holes and producing a high-tension voltage for igniting a mixed gas in cylinders and a second cover covering the ignition coils.

2. Description of the Related Art

FIG. 6 is an exploded perspective view showing an example of a conventional ignition apparatuses for an internal combustion engine and FIG. 7 is a cross sectional view taken along the line VII—VII of FIG. 6. In the drawings, a first metal cover 1 is fixed to a cylinder head (not shown) by bolts (not shown) extending through bolt holes 2. A concave recessed portion 3 is defined on the top of the first cover 1 having a trapezoid cross sectional shape at the central portion thereof. Plug holes 6 into which the plug caps 21 of ignition coils 20 are inserted are defined at intervals in the recessed portion 3 and the number of the plug holes 6 are four in the case of, for example, a four-cylinder internal combustion engine. Bolt tightening seats 7 are defined in the vicinity of the plug holes 6 to fix the ignition coils 20 to the first cover 1 by bolts 8. Further, bolt mounting seats 10 are defined around the periphery of the recessed portion 3.

A second cover 11 having a trapezoid cross sectional shape is disposed on the first cover 1 to cover the ignition coils 20. Bolt holes 12 are defined around the periphery of the second cover 11 composed on an insulating material. Bolts 13 extend through the bolt holes 12 and threaded through the bolt mounting seats 10 to fix the second cover 11 to the first cover 1.

Each of the ignition coils 20 covered with the second cover 11 includes an ignition coil main body 55, a plug cap 21, an iron core 22, mounting holes 23 defined to the iron core 22, a high-tension tower 24 and a connector 25.

A high-tension cord 30 has an end to which a plug cap 31 is attached and the other end to which connected is a high-tension connector 32 connected to a high-tension tower 24. A low-tension cord 33 is formed to a fork shape branched to two cords each extreme end of which has a low-tension connector 34 to be connected to a connector 25. The low-tension cord 33 has a base end portion connected to a power switch (not shown) for intermittently feeding a primary current to the ignition coil 20. The longer one of the high-tension cords 30 is securely positioned by the recessed portion 40A of a Y-shaped positioning member 40 fixed by a fixing hole 41 and a certain clearance is secured between the high-tension cord 30 and the ignition coil main body 55 to prevent the leakage of a high-tension voltage to the long portion of the high-tension cord 30. Since the short portion of the high-tension cord 30 has a short length, it need not be positioned by the positioning member 40.

In the above ignition apparatus for the internal combustion engine, a primary current flowing to the primary coil (not shown) of the ignition coil 20 through the power switch and low-tension cord 33 is controlled in response to a signal from a control unit (not shown) and a high-tension voltage is produced to the secondary coil (not shown) of the ignition coil 20 in response to the primary current flowing to the primary coil. The high-tension voltage is supplied to an ignition plug (not shown) of an internal combustion engine through the high-tension cord 30 and the plug cap 31 or the plug cap 21 to ignite a mixed gas in a cylinder of the internal combustion engine.

Since the high-tension voltage is produced in the ignition coil 20, and the first cover 1 is composed of metal and has a ground potential, a sufficient clearance is secured between the ignition coil 20 and the first cover 1 to prevent the discharge of the high-tension voltage to the first cover 1 by the dielectric breakdown of the case of the ignition coil 20. Further, the ignition coil 20 is fixed to the first cover 1 by fixing the iron core 22, which a high-tension voltage is not applied, to the bolt tightening seats 7 by means of the bolts 8.

In the conventional ignition apparatus for the internal combustion engine, the clearance between the first cover 1 and the ignition coil 20 must be increased to prevent the occurrence of discharge therebetween. Thus, a problem arises in that the total height of the ignition apparatus is increased, the ignition coil 20 has a center of gravity which is located at a high position with respect to the first cover 1 and the ignition coil 20 is liable to be vibrated.

Further, since the bolts 8 as tightening members are needed to fix the ignitions coils 20 to the first cover 1, there is also a problem that the number of parts and the number of mandays for tightening jobs are increased and thus a manufacturing cost is increased.

SUMMARY OF THE INVENTION

An object of the present invention made to solve the above problems is to provide an ignition apparatus for an internal combustion engine which can reduce its size, has a center of gravity located at a low position to improve a vibration resistant property, does not need tightening members for fixing ignition coils to a first cover and reduces the number of parts and the number of mandays for assembly to reduce a manufacturing cost.

Accordingly, an ignition apparatus for an internal combustion of the present invention engine comprises a first cover adapted to be fixed to a cylinder head of the internal combustion engine and having plug holes defined therein, ignition coils mounted to said cylinder head and partly inserted into said plug holes for igniting a mixed gas in cylinders and a second cover for covering said ignition coils, wherein said ignition coils are directly held by said first cover composed an electrically insulating material and said second cover composed of an electrically insulating material.

DESCRIPTION OF PREFERRED EMBODIMENTS

Embodiment 1

Figure 1:
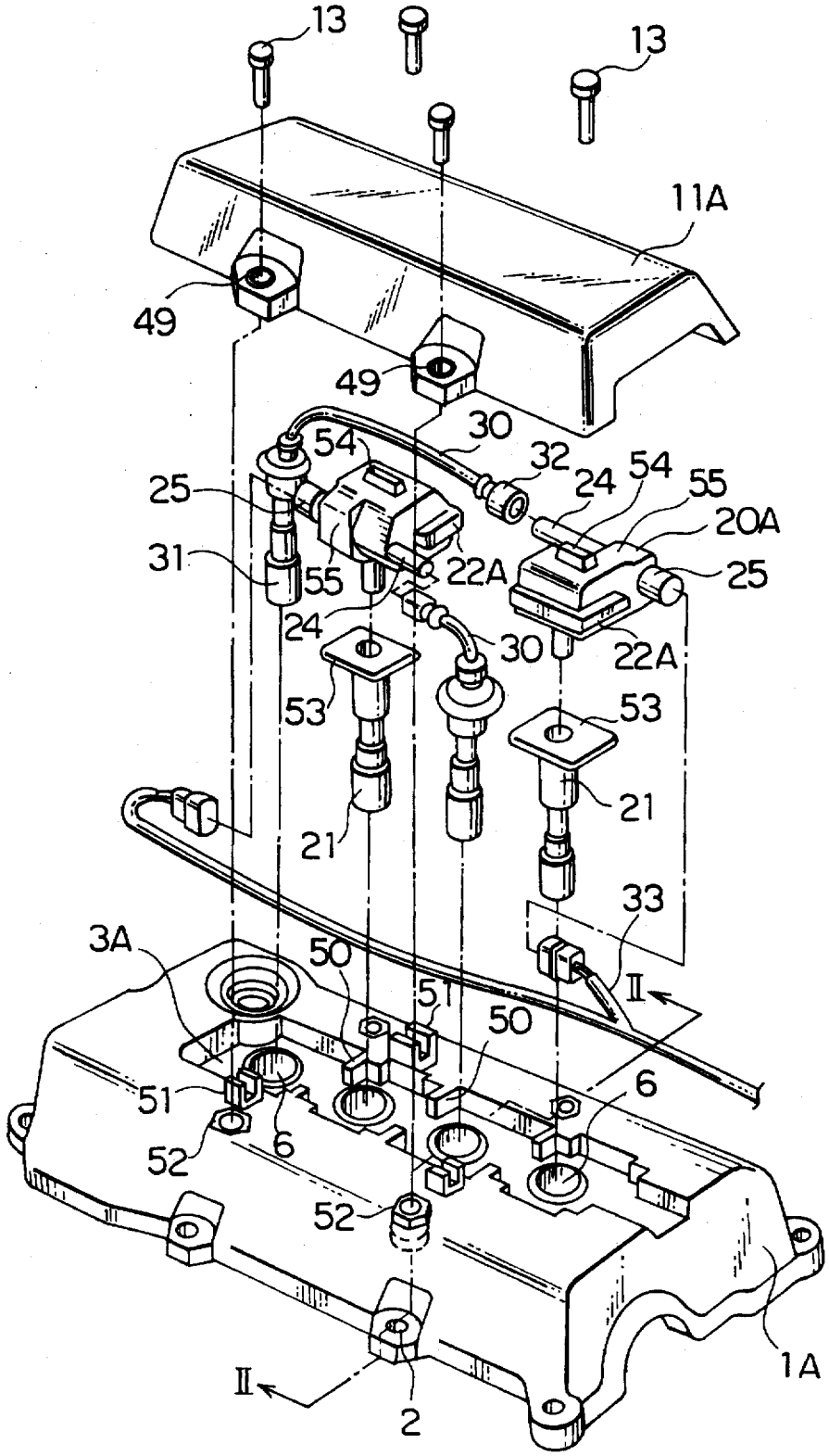
FIG. 1 is an exploded perspective view showing an embodiment of an ignition apparatus for an internal combustion engine according to the present invention.
Figure 2:
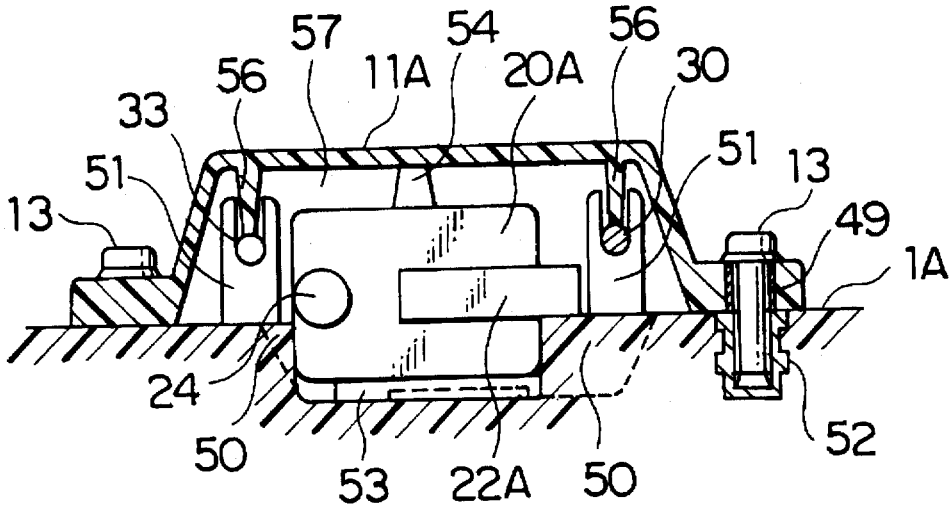
FIG. 2 is a side sectional view taken along line II—II of FIG. 1.
Figure 6:
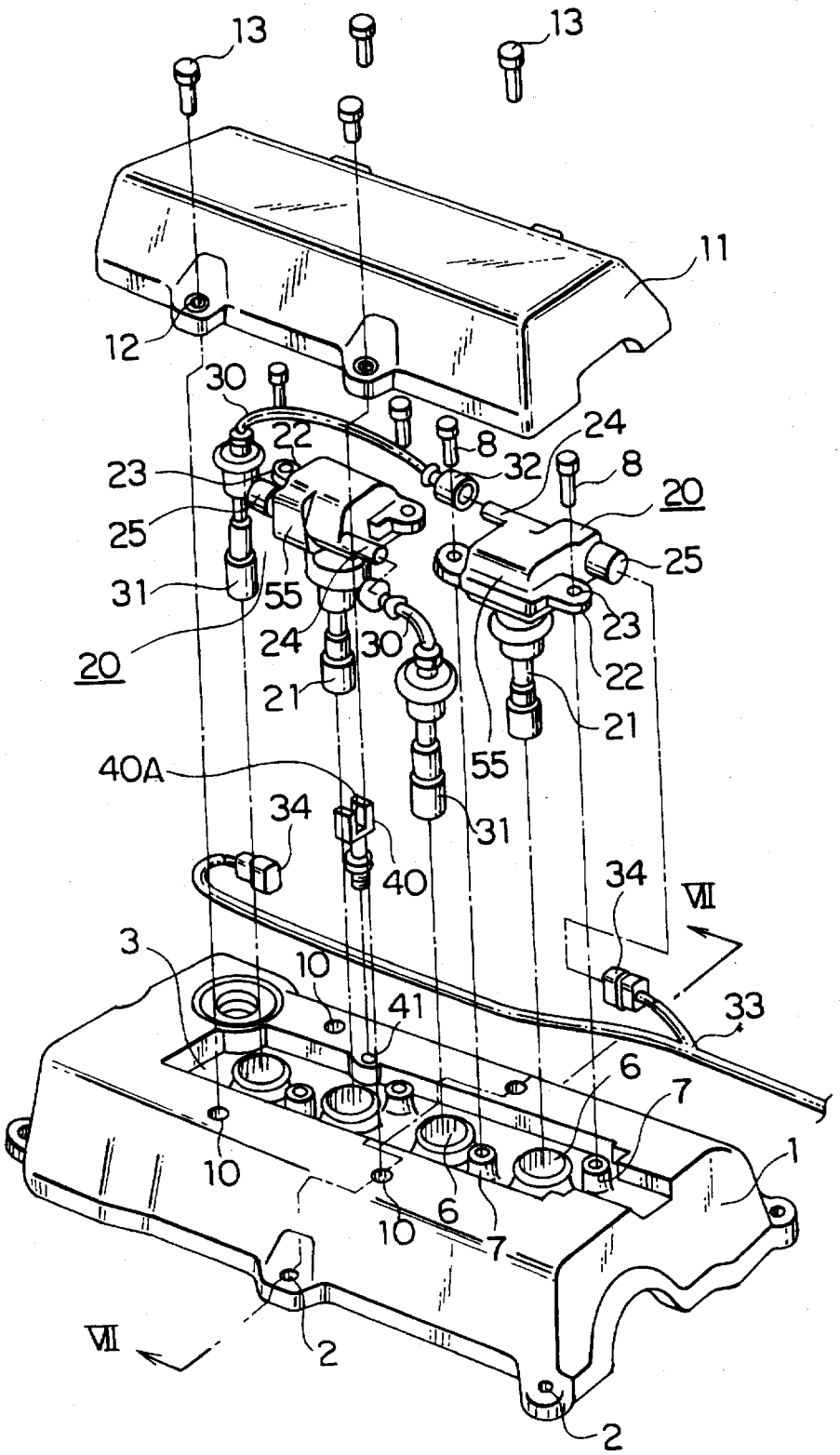
FIG. 6 PRIOR ART
FIG. 6 is an exploded perspective view showing an example of conventional ignition apparatuses for an internal combustion engine.
Figure 7:
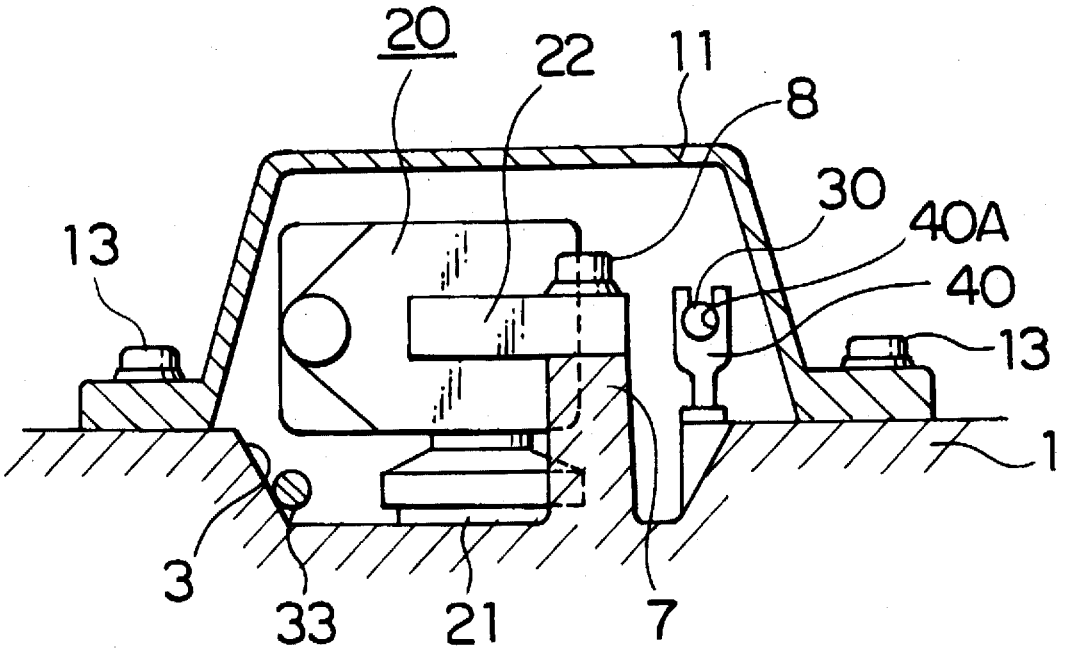
FIG. 7 PRIOR ART
FIG. 7 is a cross sectional view taken along line VII—VII of FIG. 6.

Embodiments of the present invention will be described below with reference to the drawings. FIG. 1 is an exploded perspective view showing an embodiment of the present invention and FIG. 2 is a cross sectional view taken along line II—II of FIG. 1. The same numerals as used in FIG. 6 and FIG. 7 are used in FIG. 1 and FIG. 2 to denote the same or corresponding parts and the description thereof is omitted.

In the drawings, a first cover 1A composed of an insulating resin is fixed to a cylinder head (not shown) by bolts (not shown) extending through bolt holes 2. A concave recessed portion 3A is defined to the top of the first cover 1 at the center thereof which is insert-formed to have a trapezoid cross sectional shape. Projections 50 confronting each other are formed along the inner wall surface of the recessed portion 3A to position ignition coils 20A. Positioning units 51 for positioning and holding high-tension cords 30 and low-tension cords 33 are formed at the periphery of the recessed portion 3A at three locations. Since the first cover 1A is formed as an integral, unitary member, each of the positioning units 51 has a groove of which width is sightly increasing in an upward direction. Further, bushes 52 each having a screw thread formed on the inner peripheral surface thereof are buried along the periphery of the recessed portion 3A.

A second cover 11A having a trapezoid cross sectional shape is disposed on the first cover 1A to cover the ignition coils 20A. Bushes 49 each having a screw thread formed on the inner peripheral surface thereof are buried along the periphery of the second cover 11A composed of an insulating resin. Bolts 13 are thread-engaged through the bushes 52 and bushes 49, whereby the second cover 11A is fixed to the first cover 1A. Press units 56 (FIG. 2 ) are formed on the inner surface of the second cover 11A in confrontation with the positioning units 51. The press units 56 press the high-tension cord 30 and the low-tension cord 33 as a voltage cord into the positioning units 51.

Each of the ignition coils 20A covered with the second cover 11A includes a plug cap 21, an iron core 22A, a rectangular flat-plate-shaped elastic portion 53 disposed on the upper surface of the plug cap 21, a support column 54 mounted on the upper surface of an ignition coil main body 55, a high-tension tower 24 and a connector 25.

In the above ignition apparatus for the internal combustion engine, no clearance is needed between the first cover 1A and the ignition coil 20A because the first cover 1A is composed of the insulating resin. Consequently, when the ignition coil main body 55 is positioned by the projections 50 and the plug cap 21 is inserted into a plug hole 6, since the ignition coil main body 55 can be placed on the bottom of the recessed portion 3A through the elastic portion 53, the total height of the apparatus can be lowered, so that a center of gravity can be located at a low position and a vibration resistant property can be improved.

When the second cover 11A is fixed to the first cover 1A by means of the bolts 13 which are thread-engaged through bushes 49 and bushes 52, the ignition coil 20A is fixed to an internal combustion engine in such a manner that the ignition coil main body 55 is positioned by the projections 50 to a horizontal direction, and held between the first cover 1A and the second cover 11A through the support column 54. Therefore, the bolts 8 conventionally needed to fix the ignition coil 20 to the cover 1 are not necessary.

Since the ignition coil 20A is fixed by being held between the first cover 1A and the second cover 11A, when the internal combustion engine is driven in servicing, for example, the ignition coil 20A must be inevitably be covered with the second cover 11A certainly and a worker cannot directly touch the ignition coil 20A during the servicing.

Further, an air flow path 57 is ensured to be formed between the ignition coil main body 55 and the second cover 11A by the support column 54, so that the heat from the primary coil and the like of the ignition coil 20A is smoothly discharged to the outside.

Further, the press units 56 press the high-tension cord 30 and low-tension cord 33 to position them at the positioning units 51 and a certain space is maintained between the high-tension cord 30, the low-tension cord 33 and the ignition coil 20A, so that a high-tension voltage does not leak to either of the cords 30, 33.

Embodiment 2

Figure 3:
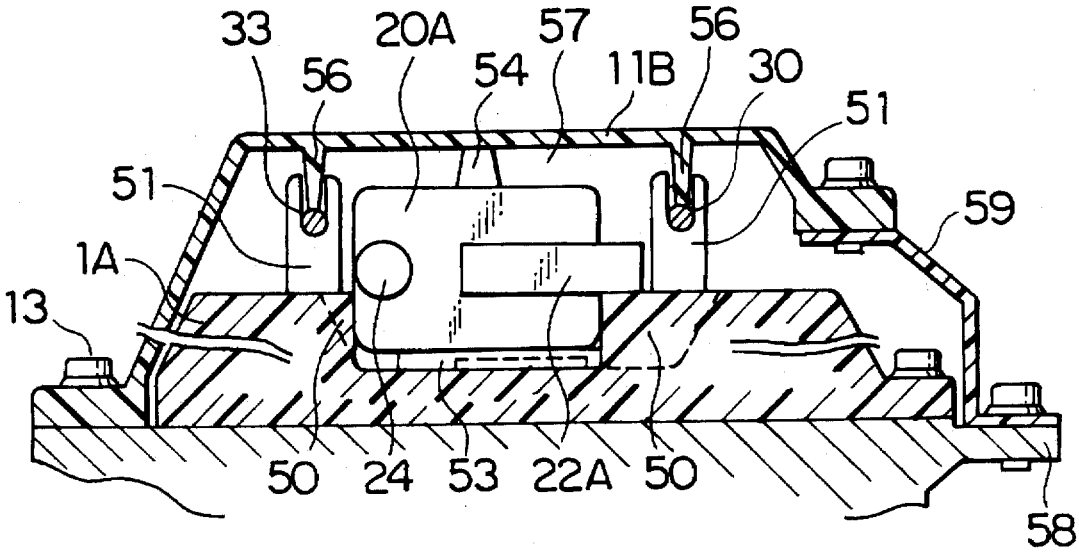
FIG. 3 is a cross sectional view showing another embodiment of the ignition apparatus for the internal combustion engine according to the present invention.

FIG. 3 is a cross sectional view showing a main portion of another embodiment or an embodiment 2 of the present invention. The embodiment 2 is different from the embodiment 1 in that one of the sides of a second cover 11B is directly fixed to a cylinder head 58 and the other side thereof is fixed to the cylinder head 58 through an intermediate member 59.

In the embodiment 1, the bushes 52 must be buried into the first cover 1A to enable the second cover 11A to be threaded through the first cover 1A composed of the insulating resin. In the embodiment 2, however, the fixing of the second cover 11B is accomplished by thread-engaging the second cover 11B directly through the metal cylinder head 58 and thereby rendering the troublesome process of burying the bushes 52 into the first cover 1A unnecessary.

Further, the intermediate member 59 is a fixing member for fixing auxiliary devices such as an air cleaner and the like and the intermediate member 59 also serves as a fixing member for fixing the second cover 11B.

Embodiment 3

Figure 4:
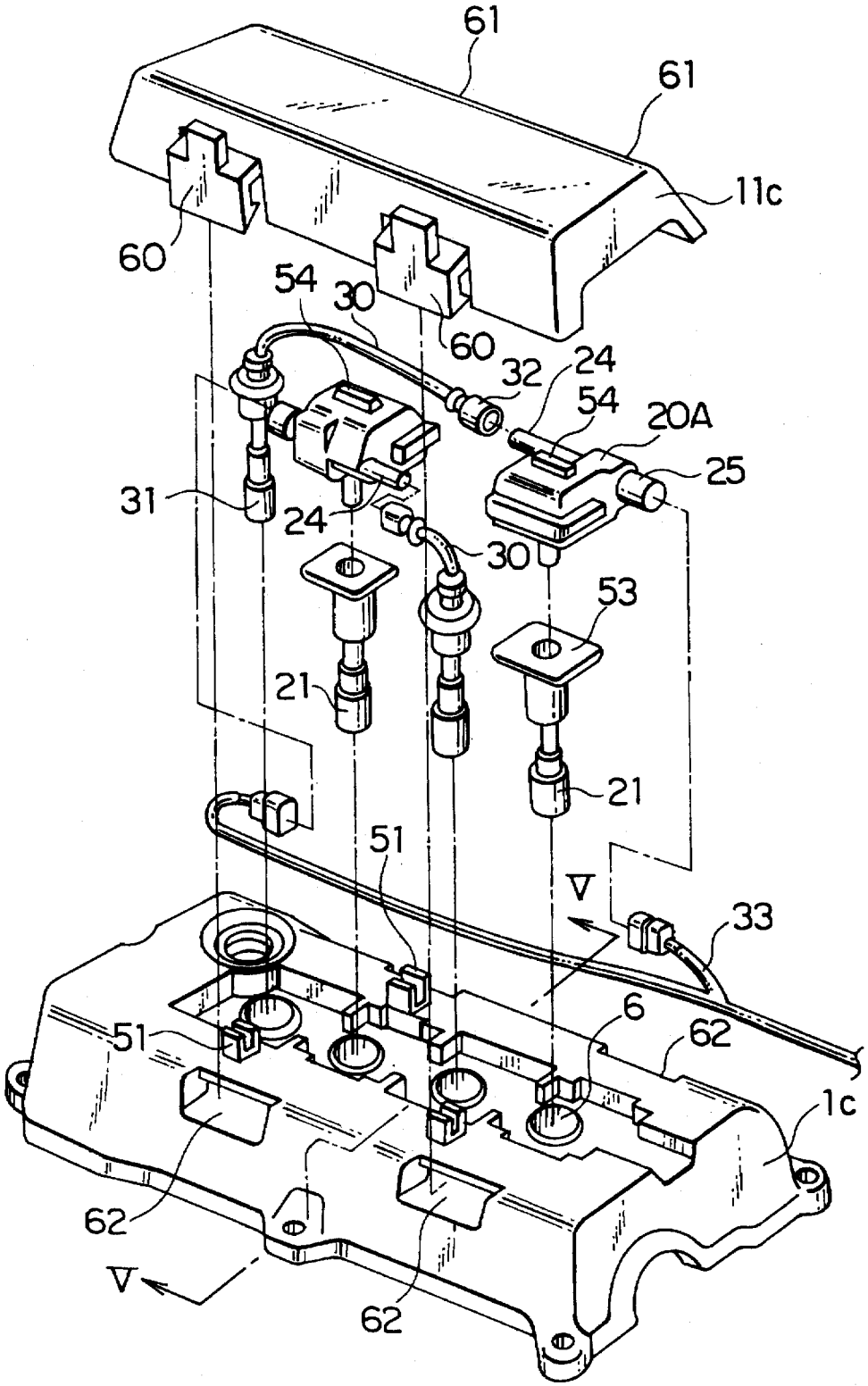
FIG. 4 is an exploded perspective view showing still another embodiment of the ignition apparatus for the internal combustion engine according to the present invention.
Figure 5:
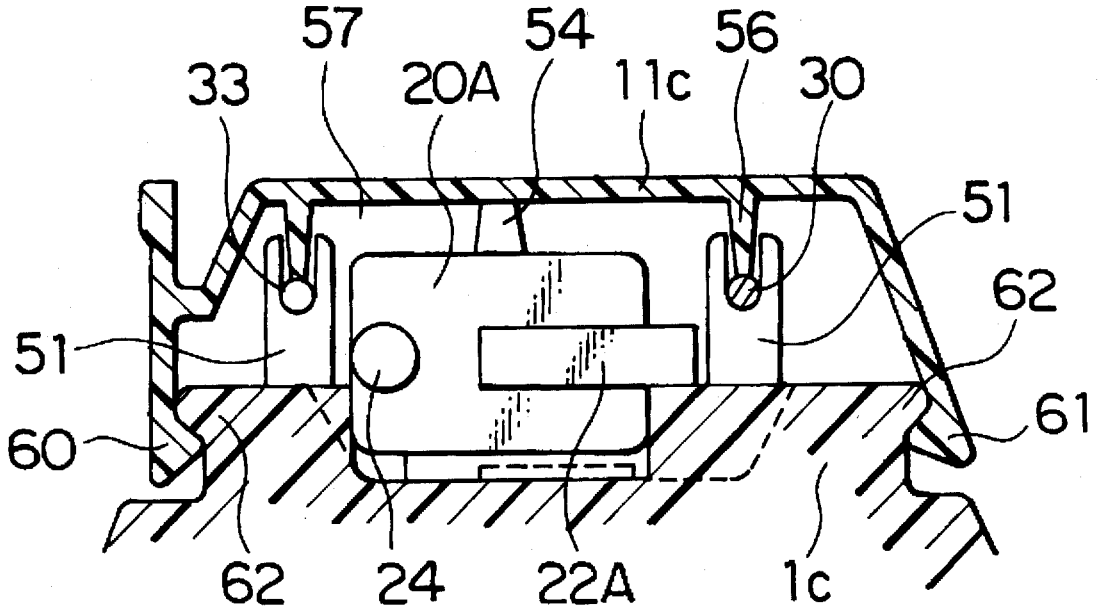
FIG. 5 is a cross sectional view taken along line V—V of FIG. 4.

FIG. 4 is an exploded perspective view showing still another embodiment or an embodiment 3 of the present invention and FIG. 5 is a cross sectional view taken along the line V—V of FIG. 4. The embodiment 3 is different from the embodiment 1 in that locking units 60,61 are formed in confrontation with each other on the both sides of a second cover 11C composed of an insulating resin and units 62 to be locked by the locking units 60,61 are formed to the first cover 1C.

In the embodiment 1, the bushes 49 must be buried into the second cover 11A and the bushed 52 must be buried into the first cover 1A, respectively and the bolts 13 are needed to enable the second cover 11A to be securely attached to the first cover 1A composed of the insulating resin. In the embodiment 3, however, the second cover 11C can be simply fixed to the first cover 1C by a one-touch operation without the need of the bushes 49, 52 and the bolts 13.

As described above, according to the ignition apparatus for the internal combustion engine of claim 1 of the present invention, since the ignition coil is fixed by being held between the first cover composed of the insulating resin and the second cover composed of the insulating resin, the total height of the ignition apparatus can be lowered because no clearance exists between the ignition coil and the second cover, thus the size of the apparatus can be also reduced. Further, since the center of gravity of the ignition apparatus is located at a low position a vibration resistant property is improved. In addition, since tightening members for fixing the ignition coil to the first cover 1 are not needed, the number of parts and the number of mandays for assembly are reduced, thus a manufacturing cost can be reduced.

According to the ignition apparatus for the internal combustion engine of the present invention, since the second cover is directly fixed to the first cover, there is an advantage that the ignition apparatus can be made more compact.

According to the ignition apparatus for the internal combustion engine of the present invention, since the metal bushes each having the screw thread formed on the inner peripheral surface thereof are buried into at least one of the first cover and the second cover, there is an advantage that the second cover can be securely fixed to the first cover without the collapse of the screw threads even if the first cover is composed of the synthetic resin.

According to the ignition apparatus for the internal combustion engine of the present invention, since the second cover is fixed to the cylinder head, there is an advantage that even if the bolts are tightened with a large tightening torque, the second cover can be securely fixed to the cylinder head without the collapse of the screw threads.

According to the ignition apparatus for the internal combustion engine of the present invention, since the second cover is fixed to the intermediate member which is fixed to the cylinder head to support, for example, an auxiliary device, there is an advantage that the support member of the auxiliary device can be also used as the fixing member of the second cover.

According to the ignition apparatus for the internal combustion engine of the present invention, since the locking units are formed on either said first cover or the second cover and the units to be elastically locked by the locking units are formed to the other of the first cover and the second cover, there is an advantage that the second cover can be simple fixed to the first cover by a one-touch operation without using tightening members.

According to the ignition apparatus for the internal combustion engine of the present invention, since the ignition coil is arranged by interposing the elastic portion between the ignition plug main body and the plug cap, there is an advantage that the plug cap can be mounted to the first cover in such a manner that the plug cap is not directly abutted against the first cover but the elastic member is abutted against the first cover, so that the wear of the first cover and plug cap caused by the vibration of the internal combustion engine can be prevented.

According to the ignition apparatus for the internal combustion engine of the present invention, since the positioning units for positioning the voltage cords connected to the ignition coil are formed to at least one of the first cover and the second cover, there is an advantage that a certain space is secured between the voltage cords and the ignition coil and the leakage of a high-tension voltage to the voltage cords is prevented.

According to the ignition apparatus for the internal combustion engine of the present invention, since the support column is disposed on at least one of the ignition coil and the second cover, there is an advantage that an air flow path is securely formed between the ignition coil and the second cover, so that the heat of the ignition coil is smoothly exhausted to the outside through the air flow path.

What is claimed is:

1. An ignition apparatus for an internal combustion engine comprising a first cover adapted to be fixed to a cylinder head of the internal combustion engine and having plug holes defined therein, ignition coils mounted to said cylinder head and partly inserted into said plug holes for igniting a mixed gas incylinders and a second cover for covering said ignition coils, wherein said ignition coils are directly held by said first cover composed of an electrically insulating material and said second cover composed of an electrically insulating material.

2. An ignition apparatus for an internal combustion engine according to claim 1, wherein said second cover is directly fixed to said first cover.

3. An ignition apparatus for an internal combustion engine according to claim 2, wherein metal bushes each having a screw thread formed on the inner wall surface thereof are buried into at least one of said first cover and said second cover and bolts are threaded through said bushes.

4. An ignition apparatus for an internal combustion engine according to claim 1, wherein said second cover is directly fixed to said cylinder head.

5. An ignition apparatus for an internal combustion engine according to claim 1, wherein said second cover is fixed to said cylinder head through an intermediate member.

6. An ignition apparatus for an internal combustion engine according to claim 1, wherein locking units are formed on either said first cover or said second cover and units to receive said locking units elastically are disposed to the other of said first cover and said second cover.

7. An ignition apparatus for an internal combustion engine according to claim 1, wherein each of said ignition coils includes an ignition coil main body, a plug cap to be inserted into said plug hole and an elastic member interposed between said plug cap and said ignition coil main body.

8. An ignition apparatus for an internal combustion engine according to claim 1, wherein positioning units are formed on at least one of said first cover and said second cover to position voltage cords connected to said ignition coil and secure a certain space between said ignition coil and said voltage cords.

9. An ignition apparatus for an internal combustion engine according to claim 1, wherein a support column is disposed on at least one of said ignition coil and said second cover to form an air flow path between said ignition coil and said second cover.

* * * * *